US007807254B2

(12) United States Patent
Bi et al.

(10) Patent No.: US 7,807,254 B2
(45) Date of Patent: Oct. 5, 2010

(54) INTERLOCKING DOCUMENT SECURITY FEATURES USING INCOMPATIBLE INKS

(75) Inventors: Daoshen Bi, Boxborough, MA (US); Robert L. Jones, Andover, MA (US)

(73) Assignee: L-1 Secure Credentialing, Inc., Billerica, MA (US)

( * ) Notice: Subject to any disclaimer, the term of this patent is extended or adjusted under 35 U.S.C. 154(b) by 0 days.

(21) Appl. No.: 11/460,129

(22) Filed: Jul. 26, 2006

(65) Prior Publication Data

US 2007/0166519 A1 Jul. 19, 2007

Related U.S. Application Data

(60) Provisional application No. 60/702,724, filed on Jul. 26, 2005.

(51) Int. Cl.
*B41M 5/00* (2006.01)
*B44C 1/17* (2006.01)
*G03G 7/00* (2006.01)

(52) U.S. Cl. ..... 428/195.1; 428/204; 428/916; 283/72; 283/74; 283/75; 283/77; 283/85; 283/92; 283/94; 283/901

(58) Field of Classification Search ..... 428/195.1, 428/204, 916; 283/72, 74, 75, 77, 85, 92, 283/94, 901
See application file for complete search history.

(56) References Cited

U.S. PATENT DOCUMENTS

| | | | | |
|---|---|---|---|---|
| 5,310,222 | A * | 5/1994 | Chatwin et al. | 283/86 |
| 5,492,370 | A * | 2/1996 | Chatwin et al. | 283/110 |
| 5,844,230 | A * | 12/1998 | Lalonde | 235/487 |
| 6,234,537 | B1 * | 5/2001 | Gutmann et al. | 283/86 |
| 2003/0062421 | A1 * | 4/2003 | Bloomberg et al. | 235/494 |

* cited by examiner

*Primary Examiner*—Mark Ruthkosky
*Assistant Examiner*—David J Joy
(74) *Attorney, Agent, or Firm*—Mintz Levin Cohn Ferris Glovsky and Popeo, P.C.

(57) ABSTRACT

A security feature for an identification document comprises a base document layer, including a first image printed with a covert ink, and a personalized image relating to a bearer of the document (such as a facial photo) printed over the first image. The personalized image is printed with an ink that is incompatible with the covert ink such that the first image becomes overt within the personalized image upon printing of the personalized image. This feature creates an interlocking relationship between the covert image, which may be pre-printed prior to personalization on card stock, and personalized information printed over the covert image. Variations of this feature can be made in which the first image is not covert, yet still creates an interlocking relationship due to ink incompatibilities. Further, the second image may depict information other than personal information.

20 Claims, 5 Drawing Sheets

INTERLOCKING DOCUMENT SECURITY FEATURES USING INCOMPATIBLE INKS

RELATED APPLICATION DATA

This patent application claims priority to U.S. Provisional Application No. 60/702,724, filed Jul. 26, 2005, which is hereby incorporated by reference.

TECHNICAL FIELD

The invention relates to secure documents and specifically relates to a security feature for secure documents such as identification documents.

BACKGROUND

As counterfeiters become increasingly sophisticated in creating counterfeit secure documents (either from scratch or modifying valid documents), there is need for increasingly effective security measures to thwart them. One way to thwart counterfeiters is to insert features into documents that are difficult to reproduce. In some cases, these features are intended to be covert so that it is difficult for the counterfeiter to even identify their presence on the document. As an additional layer of security, these features should have a linking relationship with other features that interlock the features to increase the difficulty in accurately reproducing the relationship and show evidence of tampering when the relationship is broken. The attributes identified above are needed for a broad spectrum of secure documents, and are particularly useful in identification documents. To provide context for forensic security features in identification documents, a description of these documents and methods for creating them follows below.

Secure Documents

Secure documents, and in particular, identification documents (hereafter "ID documents") play a critical role in today's society. One example of an ID document is an identification card ("ID card"). ID documents are used on a daily basis—to prove identity, to verify age, to access a secure area, to evidence driving privileges, to cash a check, and so on. Airplane passengers are required to show an ID document during check in, security screening and prior to boarding their flight. In addition, because we live in an ever-evolving cashless society, ID documents are used to make payments, access an automated teller machine (ATM), debit an account, or make a payment, etc.

For the purposes of this disclosure, ID documents are broadly defined herein, and include, e.g., credit cards, bank cards, phone cards, passports, driver's licenses, network access cards, employee badges, debit cards, security cards, smart cards (e.g., cards that include one more semiconductor chips, such as memory devices, microprocessors, and microcontrollers), contact cards, contactless cards, proximity cards (e.g., radio frequency (RFID) cards), visas, immigration documentation, national ID cards, citizenship cards, social security cards, security badges, certificates, identification cards or documents, voter registration cards, police ID cards, border crossing cards, legal instruments, security clearance badges and cards, gun permits, gift certificates or cards, membership cards or badges, etc.

Many types of identification documents carry certain items of information which relate to the identity of the bearer. Examples of such information include name, address, birth date, signature and photographic image; the cards or documents may in addition carry other variable data (i.e., data specific to a particular card or document, for example an employee number) and invariant data (i.e., data common to a large number of cards, for example the name of an employer). All of the cards described above will be generically referred to as "ID documents".

FIGS. 1 and 2 illustrate a front view and cross-sectional view (taken along the A-A line), respectively, of an identification (ID) document 10. In FIG. 1, the ID document 10 includes a photographic image 12, a bar code 14 (which may contain information specific to the person whose image appears in photographic image 12 and/or information that is the same from ID document to ID document), variable personal information 16, such as an address, signature, and/or birthdate, and biometric information 18 associated with the person whose image appears in photographic image 12 (e.g., a fingerprint, a facial image or template, or iris or retinal template), a magnetic stripe (which, for example, can be on a side of the ID document that is opposite the side with the photographic image), and various security features, such as a security pattern (for example, a printed pattern comprising a tightly printed pattern of finely divided printed and unprinted areas in close proximity to each other, such as a fine-line printed security pattern as is used in the printing of banknote paper, stock certificates, and the like).

Referring to FIG. 2, the ID document 10 comprises a preprinted core 20 (also referred to as a substrate). In many applications, the core can be a light-colored, opaque material (e.g., TESLIN (available from PPG Industries), polyvinyl chloride (PVC) material, polyester, polycarbonate, etc.). The core 20 is laminated with a transparent material, such as clear polycarbonate, PVC or polyester material 22, which, by way of example, can be about 1-10 mil thick. The composite of the core 20 and clear laminate material 22 form a so-called "card blank" 25 that can be up to about 27 to 33 mils thick in accordance with ANSI standards. Information 26*a-c* is printed on the card blank 25 using a method such as Laser Xerography or Dye Diffusion Thermal Transfer ("D2T2") printing (e.g., as described in commonly assigned U.S. Pat. No. 6,066,594, which is incorporated by reference). The information 26*a-c* can, for example, comprise variable information (e.g., bearer information) and an indicium or indicia, such as the invariant or nonvarying information common to a large number of identification documents, for example the name and logo of the organization issuing the documents. The information 26*a-c* may be formed by any known process capable of forming the indicium on the specific core material used.

To facilitate printing of data on the card structure, an image receiving layer is applied to the card structure prior to printing for some printing technologies. One type of printing technology that uses an image receiving layer is D2T2 printing. U.S. Pat. Nos. 6,066,594 and 5,334,573 describe image receiving layers for D2T2 printing. A sheet or layer which is comprised of a polymer system of which at least one polymer is capable of receiving image-forming materials from a donor sheet upon the application of heat. The polymer system of the receiving sheet or layer is incompatible or immiscible with the polymer of the donor sheet at the receiving sheet/donor sheet interface to minimize adhesion between the donor sheet and the receiving sheet or layer during printing. The polymer system of the receiving sheet or layer can be substantially free from release agents, such as silicone-based oils, poly(organosiloxanes), fluorinated polymers, fluorine- or phosphate-containing surfactants, fatty acid surfactants and waxes. Binder materials for the dyes are immiscible with the polymer system of the image-receiving layer. The most common image-receiving layer polymers are polyester, polycaprolactone and poly(vinyl chloride). Processes for forming such image-receiving layers are also described in detail in these patents; in most cases, the polymer(s) used to form the image-receiving layer are dissolved in an organic solvent, such as methyl ethyl ketone, dichloromethane or chloroform, and the resultant solution coated on to the polymer layer using conventional coating apparatus, and the solvent evaporated to form the image-receiving layer. However, if desired the image-receiving layer can be applied to the polymer layer by extrusion casting, or by slot, gravure or other known coating methods.

Other forms of image receiving layers include image receiving layers for Xerographic printing and inkjet printing. These image receiving layers are applied to substrates such as paper or plastic and comprise materials that enhance reception of ink or dye to the substrate. Image receiving layers for Xerographic printing are sometimes referred to as "laser lock" or "toner lock."

To protect the information that is printed, an additional layer of transparent overlaminate 24 can be coupled to the card blank and printed information. Illustrative examples of usable materials for overlaminates include biaxially oriented polyester or other optically clear durable plastic film.

"Laminate" and "overlaminate" include, but are not limited to film and sheet products. Laminates used in documents include substantially transparent polymers. Examples of laminates used in documents include polyester, polycarbonate, polystyrene, cellulose ester, polyolefin, polysulfone, and polyamide. Laminates can be made using either an amorphous or biaxially oriented polymer. The laminate can comprise a plurality of separate laminate layers, for example a boundary layer and/or a film layer.

The degree of transparency of the laminate can, for example, be dictated by the information contained within the identification document, the particular colors and/or security features used, etc. The thickness of the laminate layers can vary and is typically about 1-20 mils. Lamination of any laminate layer(s) to any other layer of material (e.g., a core layer) can be accomplished using known lamination processes.

In ID documents, a laminate can provide a protective covering for the printed substrates and a level of protection against unauthorized tampering (e.g., a laminate would have to be removed to alter the printed information and then subsequently replaced after the alteration.). Various lamination processes are disclosed in assignee's U.S. Pat. Nos. 5,783,024, 6,007,660, 6,066,594, and 6,159,327. Other lamination processes are disclosed, e.g., in U.S. Pat. Nos. 6,283,188 and 6,003,581. A co-extruded lamination technology appears in U.S. patent application Ser. No. 10/692,463. Each of these U.S. Patents and applications is herein incorporated by reference.

The material(s) from which a laminate is made may be transparent, but need not be. Laminates can include synthetic resin-impregnated or coated base materials composed of successive layers of material, bonded together via heat, pressure, and/or adhesive. Laminates also includes security laminates, such as a transparent laminate material with proprietary security technology features and processes, which protects documents of value from counterfeiting, data alteration, photo substitution, duplication (including color photocopying), and simulation by use of materials and technologies that are commonly available. Laminates also can include thermosetting materials, such as epoxy.

Manufacture Environments

Commercial systems for issuing ID documents are of two main types, namely so-called "central" issue (CI), and so-called "on-the-spot" or "over-the-counter" (OTC) issue.

CI type ID documents are not immediately provided to the bearer, but are later issued to the bearer from a central location. For example, in one type of CI environment, a bearer reports to a document station where data is collected, the data are forwarded to a central location where the card is produced, and the card is forwarded to the bearer, often by mail. Another illustrative example of a CI assembling process occurs in a setting where a driver renews her license by mail or over the Internet, then receives a drivers license card through the mail.

A CI assembling process is more of a bulk process facility, where many cards are produced in a centralized facility, one after another. (For example, picture a setting where a driver passes a driving test, but then receives her license in the mail from a CI facility a short time later. The CI facility may process thousands of cards in a continuous manner.).

Centrally issued identification documents can be produced from digitally stored information and generally comprise an opaque core material (also referred to as "substrate"), such as paper or plastic, sandwiched between two or more layers of clear plastic laminate, such as polyester, to protect the aforementioned items of information from wear, exposure to the elements and tampering. U.S. Pat. No. 6,817,530, which is hereby incorporated by reference, describes approaches for manufacturing identification documents in a central issue process.

In contrast to CI identification documents, OTC identification documents are issued immediately to a bearer who is present at a document-issuing station. An OTC assembling process provides an ID document "on-the-spot". An example of an OTC assembling process is a Department of Motor Vehicles ("DMV") setting where a driver's license is issued to a person, on the spot, after a successful exam. In some instances, the very nature of the OTC assembling process results in small, sometimes compact, printing and card assemblers for printing the ID document.

OTC identification documents of the types mentioned above can take a number of forms, depending on cost and desired features. Some OTC ID documents comprise highly plasticized poly(vinyl chloride) or have a composite structure with polyester laminated to 0.5-4.0 mil (13-104 .mu.m) poly (vinyl chloride) film on the outside of typical PVC or Composite cards, which provides a suitable image receiving layer for heat transferable dyes which form a photographic image, together with any variant or invariant data required for the identification of the bearer. These data are subsequently protected to varying degrees by clear, thin (0.125-0.250 mil, 3-6 .mu.m) overlay patches applied at the printhead, holographic hot stamp foils (0.125-0.250 mil 3-6 .mu.m), or a clear polyester laminate (0.5-10 mil, 13-254 .mu.m) supporting common security features. These last two types of protective foil or laminate sometimes are applied at a laminating station separate from the printhead. The choice of laminate dictates the degree of durability and security imparted to the system in protecting the image and other data. One form of overlay is referred to as a "transferred panel" or "O-panel." This type of panel refers to a panel in the print ribbon that is transferred to the document with the use of the printhead.

SUMMARY

The invention provides security features for secure documents, including features that enable verification. The invention also provides methods for making the security features, document structures including these features, and methods for evaluating these features in suspect documents.

One aspect of the invention is a security feature for an identification document. The feature comprises a base document layer, including a first image printed with a covert ink, and a personalized image relating to a bearer of the document (such as a facial photo) printed over the first image. The personalized image is printed with an ink that is incompatible with the covert ink such that the first image becomes overt within the personalized image upon printing of the personalized image. This feature creates an interlocking relationship between the covert image, which may be pre-printed prior to personalization on card stock, and personalized information printed over the covert image. Variations of this feature can be made in which the first image is not covert, yet still creates an interlocking relationship due to ink incompatibilities. Further, the second image may depict information other than personal information.

Another aspect of the invention is a method for making a security feature for an identification document. The method provides a base document layer, prints a first image on the base document layer, captures personal information of a document bearer, and prints over the first image a personalized image relating to a bearer of the document based on the captured personal information. The personalized image is printed with an ink that is incompatible with material used to apply the first image to the base document layer such that the first image is visible within the personalized image.

Another aspect of the invention is a method of verifying an identification document. This method scans an identification document that includes document stock attributes embedded in personalized information on the document. The document stock attributes and the personalized information have an interlocking relationship to facilitate verification of the document. The method extracts information embedded in the personalized information, and evaluates the interlocking relationship between the embedded information and the document stock attributes. The document stock attributes can include attributes of the ink used to create the document stock, attributes of the document stock (paper or polymer attributes, embedded forensic chemical compositions, taggant signatures, etc.), issuer information (such as issuer identity, issuer location, time and place of manufacture, lot number, printer device information, etc.).

Additional features will become apparent with reference to the following detailed description and accompanying drawings.

BRIEF DESCRIPTION OF THE DRAWINGS

The advantages, features, and aspects of embodiments of the invention will be more fully understood in conjunction with the following detailed description and accompanying drawings, wherein.

Figure 1:
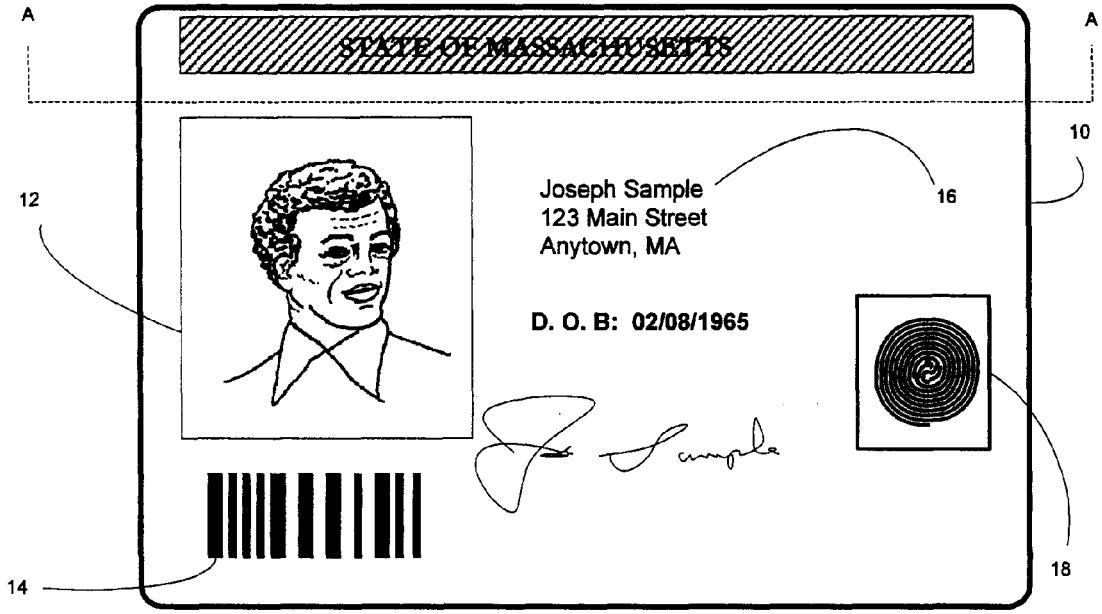
FIG. 1 is an illustrative example of an identification document.
Figure 2:
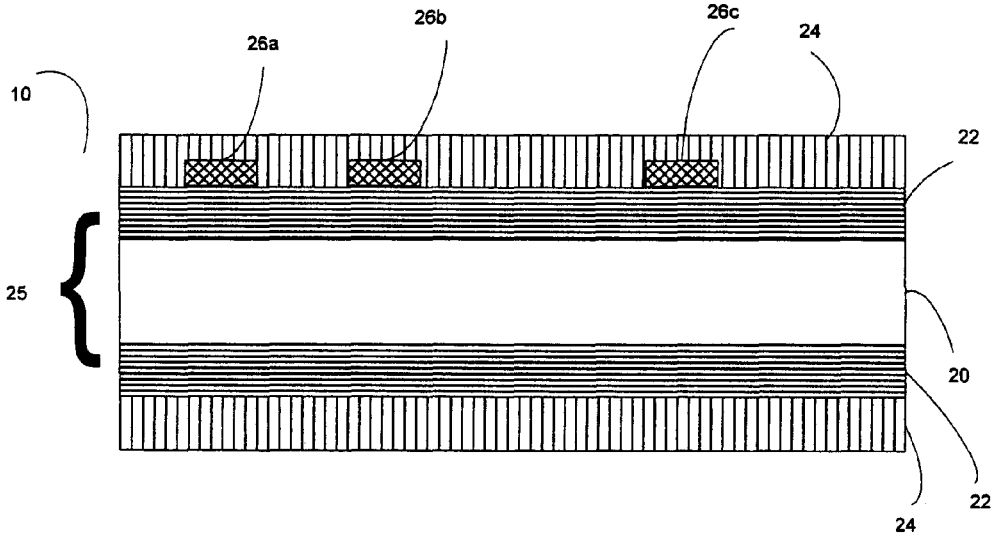
FIG. 2 is an illustrative cross section of the identification document of FIG. 1, taken along the A-A line.

Of course, the drawings are not necessarily drawn to scale, with emphasis rather being placed upon illustrating the principles of the invention. In the drawings, like reference numbers indicate like elements or steps. Further, throughout this application, certain indicia, information, identification documents, data, etc., may be shown as having a particular cross sectional shape (e.g., rectangular) but that is provided by way of example and illustration only and is not limiting, nor is the shape intended to represent the actual resultant cross sectional shape that occurs during manufacturing of identification documents.

DETAILED DESCRIPTION

Figure 3:
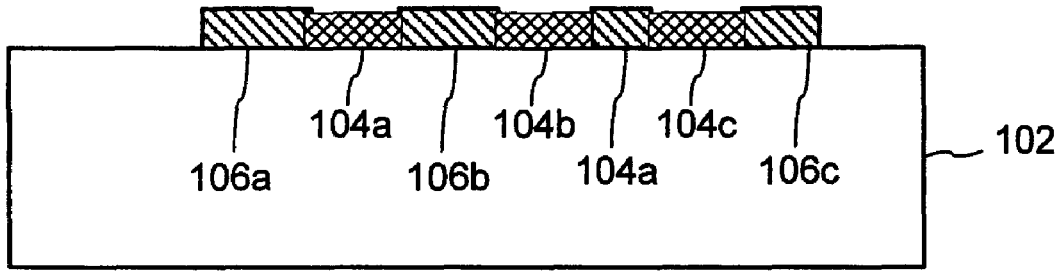
FIG. 3 is a diagram illustrating a cross section of a document structure including a security feature based on incompatibility of inks.

FIG. 3 is a diagram illustrating a cross section of a document structure including a security feature based on incompatibility of inks used for preprint and overprinted images to create an interlocking relationship between the images. These images are formed on a base document layer 102, which may be the core or substrate or a separate film or laminate layer of an identification document (with or without coating to receive certain types of inks). In applications where added durability of the ID document is required such as driver's licenses, the base layer is typically integrated within the multi-layer document structure (e.g., in a TESLIN-core, PVC-core or Polycarbonate-core multi-layered ID document structure). For temporary identification documents, the base layer typically corresponds to the substrate of the document stock, such as a security paper.

An image 104*a-c* is printed on the substrate. In one embodiment, this image 104*a-c* is a preprinted, covert image printed on ID card stock. Covert, in this context, refers to a material that is substantially imperceptible to a human viewer under normal, ambient lighting conditions (e.g., illumination in the visible band). For example, in one embodiment, a graphic of the issuer is printed in a substantially imperceptible UV ink. For some temporary ID documents, this ink comprises a UV lacquer printed with an offset press on a security paper substrate. The image may include fixed or variable information of the issuer or bearer. Preferably, the image is unique to the issuer and has unique attributes that enable the attributes of the blank ID card stock to be interlocked with other information printed on the card (e.g., such as personalized information gathered from a prospective bearer at enrollment).

A second image 106*a-c* is printed over the first image 104*a-c* using an incompatible ink to create an interlocking security feature. This ink is incompatible because it does not wet out on the first image due to the differences in surface tension of the inks. For example, the surface tension of the ink of the first image is lower relative to the second ink. While surfactants are sometimes added to inks to lower their surface tension and make them wet out more effectively on other inks or materials, the ink used to overprint the second image on the first is specifically selected to have a higher surface tension in our embodiment. For example in one embodiment, we print a higher surface tension, water-based ink with an ink jet printer over the first image printed with a lower surface tension UV ink. The water-based ink does not wet out on the pre-printed UV ink, but instead, beads up and runs off in the areas where the first image is printed. This creates an effect as shown in FIG. 3 where the graphic represented in the printed elements of the first image 104*a-c* becomes overt and visible in the second image 106*a-c* that is ink jet printed over it. FIG. 3 shows how both the first and second images adhere to the substrate, but have substantially no adherence to each other.

Other combinations of inks may be chosen to have the desired incompatibility properties that create the interlocking effect described above. Inks for the preprint and overprinted images may be selected from a group consisting of UV, solvent, water, or wax-based inks with the relative surface tension selected to minimize the wetting out of the overprinted image on the preprinted image.

Figure 4:
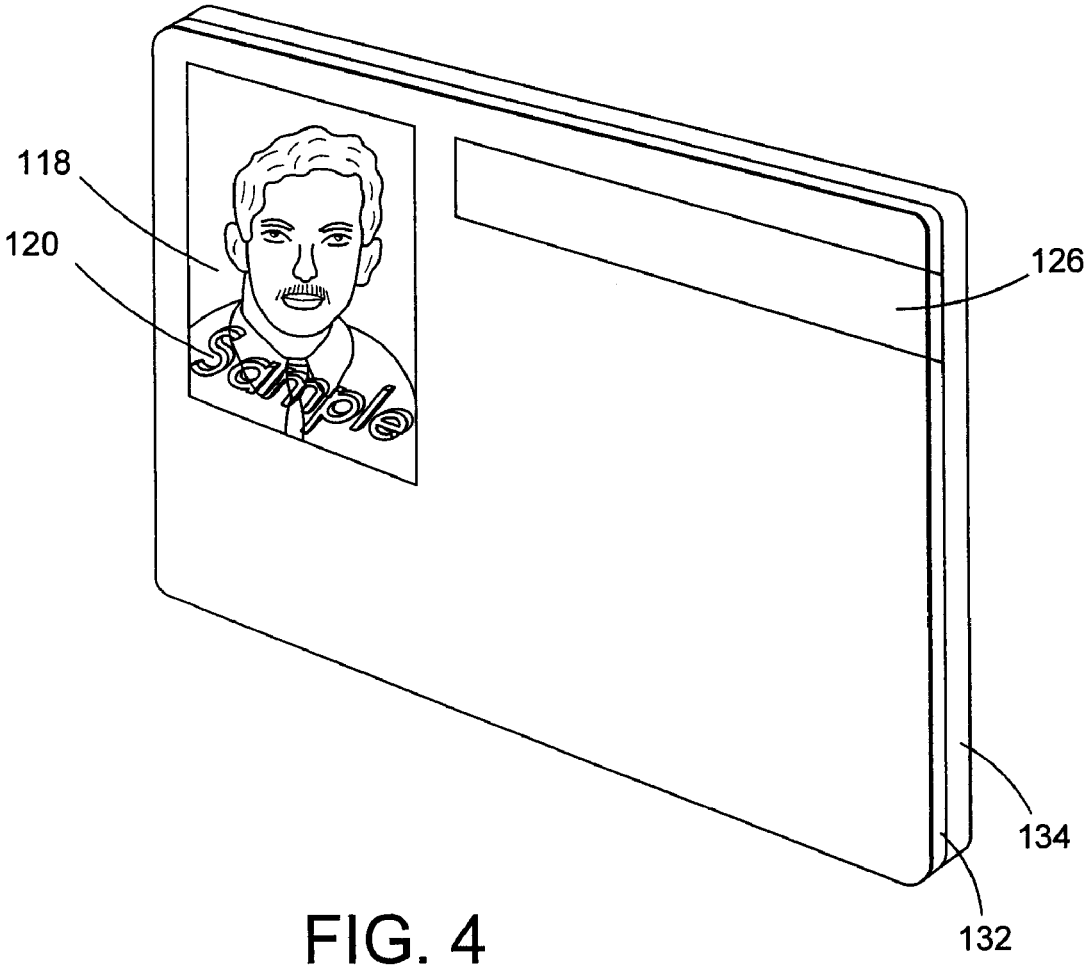
FIG. 4 is a diagram illustrating an example of identification document with security feature created within a photo of the bearer.

The second image 106*a-c* preferably depicts personal information, such as a photo of the bearer, in the embodiment, but may alternatively convey other personal or variable information. FIG. 4 is a diagram illustrating an example of identification document with security feature created within a photo of the bearer. In this case, the image of the bearer is printed over a pre-printed image of the word "sample." In cases where bearer information is available at the time of preprinting, the word "sample" may correspond to bearer information, such as his name, birth date, document number, etc. However, in a typical embodiment, the word "sample" corresponds to issuer information and is preprinted on blank card stock prior to enrollment where personal information is captured. This issuer information may include forensic information to link the document to the issuer, such as issuer identity, issuer location, time and place of manufacture, lot number, printer device information, etc. This information may be conveyed in a machine readable data carrier encoded in the first image, such as a bar code, digital watermark, two dimensional message symbology, glyph, etc.

As shown in FIG. 4, the ID document may include other fixed and variable information 126, and may be constructed in multiple layers 132, 134. In one embodiment, the preprinted and overprinted images are printed on a substrate 134 (which itself may be created from joining two or more layers), and a laminate 132 is applied over the document.

Figure 5:
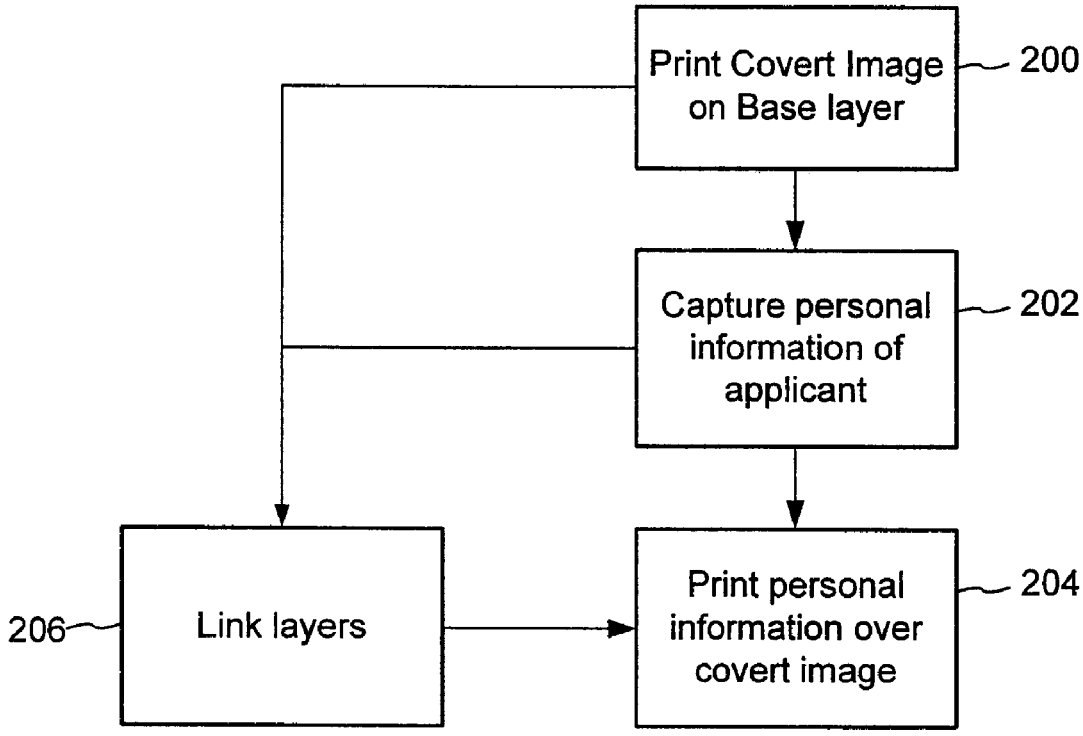
FIG. 5 is a flow diagram illustrating a method for making a security feature for a document based on incompatibilities of inks.

FIG. 5 is a flow diagram illustrating a method for making a security feature for a document based on incompatibilities of inks. As shown in step 200, the method begins by printing a first image (e.g., a covert image) on the base layer. This image wets out and adheres well to the base layer. In cases where personal information has not yet been captured, the first image conveys issuer information, but not personal information of the bearer. Personal information of the applicant is captured such as name, date of birth, address, and biometric information such as a facial image, signature, iris/retinal scan, fingerprint, etc. as shown in step 202. In step 204, personal information is then printed over the covert image using an ink that adheres to the base but does not wet out over portions of covert image printed with an incompatible ink. Information derived from the document stock (e.g., from the preprinted image and/or substrate) is gathered and embedded in the overprinted image to interlock the different layers of ink logically in addition to physical interlocking that occurs due to the ink incompatibility and spatial relationship of the preprinted and overprinted images.

Examples of this information derived from the document stock include attributes of the preprinted image and attributes of the substrate on which it is printed. Attributes of the preprinted image include digital data embedded in the first image and data conveyed in the spatial pattern of the first image. In both cases, this digital data may be carried in a machine readable data carrier such as a digital watermark or bar code encoded in the first image. The digital watermark may be steganographically embedded in the first image using techniques described in U.S. Pat. Nos. 6,122,403 and 6,614,914, which are hereby incorporated by reference. In particular, a digital data message, such as an issuer identifier or document identifier (which also may serve as an index to a database entry for the document including additional document and issuer information) is error correction encoded, scrambled, mapped to locations within a host signal, and used to modify features at those locations to embed the digital data.

Additional attributes of the preprinted image include attributes of the ink, such as ratio of compounds or taggants that are included in it, optical properties such as responses to particular types of illumination that create a unique optical signature (e.g., IR or UV fluorescing properties, such as response wavelength and/or decay times after activation), thermal characteristics (thermochromic ink signature), or magnetic characteristics (unique magnetic fingerprint).

Attributes of the substrate include paper or polymer attributes (such as a unique fingerprint of the paper fiber or polymer structure), embedded forensic chemical compositions, taggant signatures, etc.

These attributes of the document stock are embedded in the overprinted image, preferably using steganographic techniques, such as digital watermarking as described in U.S. Pat. Nos. 6,122,403 and 6,614,914.

Figure 6:
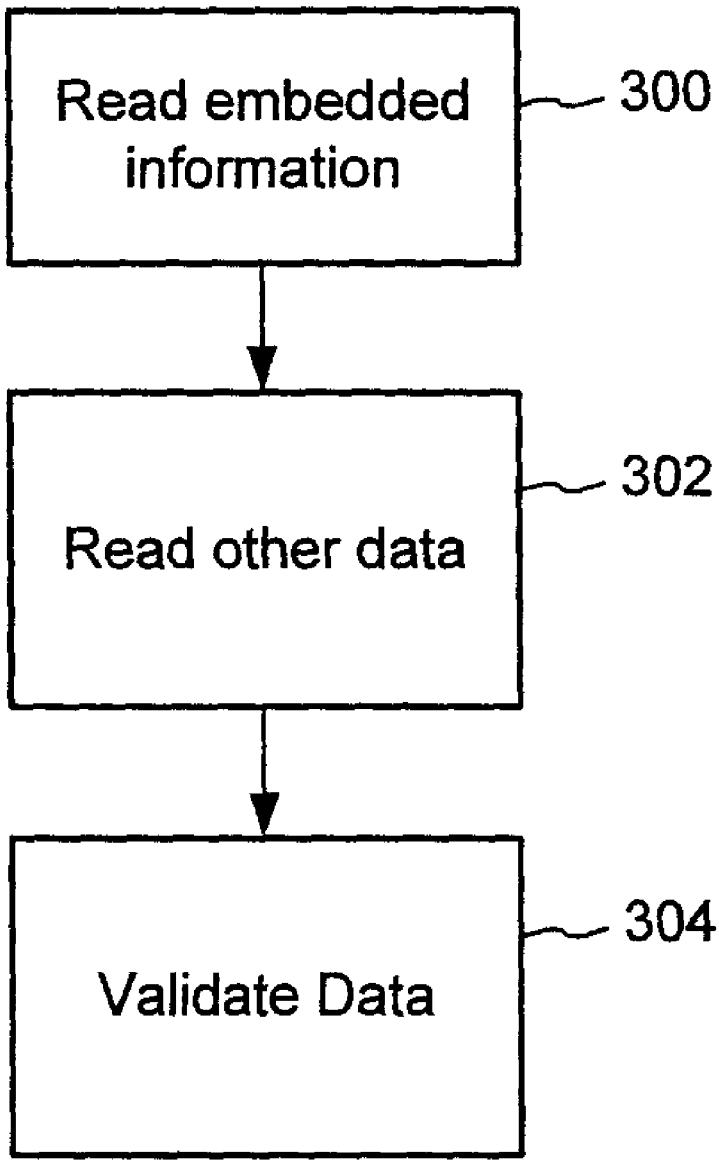
FIG. 6 is a flow diagram illustrating a method of verifying a document based on an interlocking relationship of document stock attributes and printed information.

FIG. 6 is a flow diagram illustrating a method of verifying a document based on an interlocking relationship of document stock attributes and printed information. This method begins by reading the information embedded in the overprinted image as shown in step 300. Other data is then read from the document, such as the date conveyed in the first image, or data derived from measuring the attributes of the document stock as shown in step 302. Additional information may be obtained from data elsewhere in the document (such as in chips, digital watermarks, bar codes magnetic stripes, OCR, etc.) and from a database indexed by an identifier carrier on the document. Finally, this data is validated by evaluating the relationship between the various data read from and derived from the document and the database (304). This evaluation may include a comparison of numbers, a comparison of extracted patterns, evaluation of a hash derived from document attributes to a hash stored in the document, attempted decryption of data in the document based on a key derived from the document or database, etc. If the evaluation establishes that the relationship among the data elements is valid, the document is deemed to be valid.

CONCLUDING REMARKS

Having described and illustrated the principles of the technology with reference to specific implementations, it will be recognized that the technology can be implemented in many other, different, forms, and in many different environments.

The technology disclosed herein can be used in combination with other technologies. Also, instead of ID documents, the inventive techniques can be employed with product tags, product packaging, labels, business cards, bags, charts, smart cards, maps, labels, etc. The term ID document is broadly defined herein to include these tags, maps, labels, packaging, cards, etc.

It should be understood that, in the Figures of this application, in some instances, a plurality of method steps may be shown as illustrative of a particular method, and a single method step may be shown as illustrative of a plurality of a particular method steps. It should be understood that showing a plurality of a particular element or step is not intended to imply that a system or method implemented in accordance with the invention must comprise more than one of that element or step, nor is it intended by illustrating a single element or step that the invention is limited to embodiments having only a single one of that respective elements or steps. In addition, the total number of elements or steps shown for a particular system element or method is not intended to be limiting; those skilled in the art will recognize that the number of a particular system element or method steps can, in some instances, be selected to accommodate the particular user needs.

To provide a comprehensive disclosure without unduly lengthening the specification, applicants hereby incorporate by reference each of the U.S. patent documents referenced above.

The technology and solutions disclosed herein have made use of elements and techniques known from the cited documents. Other elements and techniques from the cited documents can similarly be combined to yield further implementations within the scope of the present invention.

Thus, the exemplary embodiments are only selected samples of the solutions available by combining the teachings referenced above. The other solutions necessarily are not exhaustively described herein, but are fairly within the understanding of an artisan given the foregoing disclosure and familiarity with the cited art. The particular combinations of elements and features in the above-detailed embodiments are exemplary only; the interchanging and substitution of these teachings with other teachings in this and the incorporated-by-reference patent documents are also expressly contemplated.

In describing the embodiments of the invention illustrated in the figures, specific terminology is used for the sake of clarity. However, the invention is not limited to the specific terms so selected, and each specific term at least includes all technical and functional equivalents that operate in a similar manner to accomplish a similar purpose.

What is claimed is:

1. A security feature for an identification document, the feature comprising:

a base document layer, including a first image printed with a first ink having a first surface tension, the first ink being covert to a human viewer under normal, ambient lighting conditions, the first image bonding to the base document layer; and a personalized image relating to a bearer of the identification document printed over the first image, the personalized image comprising a second ink that is incompatible with the first ink the second ink having a surface tension which is higher than the first surface tension of the first ink, wherein the second ink does not wet out on the first image printed such that the personalized image does not bond to the first image but does bond to the base document layer in areas where the first image is printed and wherein the printed areas of the first image are embedded within the personalized image and become overt and visible to a human viewer upon printing of the personalized image.

2. The security feature of claim 1 wherein the first ink comprises a UV ink.

3. The security feature of claim 1 wherein the personalized image is printed with an ink jet ink.

4. The security feature of claim 3 wherein the ink jet ink comprises a water based ink.

5. The security feature of claim 1 wherein the first ink comprises a UV ink, a solvent based ink, or a water based ink.

6. The security feature of claim 1 wherein the first ink is pre-printed prior to personalization of the identification document.

7. The security feature of claim 6 wherein the personalized image is printed with an image captured of the bearer.

8. The security feature of claim 6 wherein the first ink is offset printed.

9. The security feature of claim 1, wherein at least a portion of the first image and at least a portion of the second image are interlocked such that the one or more portions of the first image within the second image are visible to a human viewer.

10. The security feature of claim 1, wherein the first image comprises information of the bearer or an issuer of the identification document.

11. The security feature of claim 1, wherein the first image is encoded with data relating to at least one of: the bearer of the identification document and an issuer of the identification document.

12. The security feature of claim 11, wherein the encoded data is incorporated in a machine readable data carrier encoded in the first image.

13. The security feature of claim 12, wherein the carrier includes a bar code, a digital watermark, a two dimensional message symbology, and combinations thereof.

14. The security feature of claim 1, wherein the base document layer comprises a multi-layer substrate, one layer of a multi-layer substrate, a core of a document structure, or a film or laminate layer of a document structure.

15. A method for making a security feature for an identification document, the method comprising:

providing a base document layer;

printing a first image on the base document layer with a first ink, the first ink being covert to a human viewer under normal, ambient lighting conditions;

capturing personal information of a an identification document bearer to produce a personalized image; and printing over the first image the personalized image with a second ink, the personalized image relating to a bearer of the document and based on the captured personal information, the second ink being incompatible with the first ink used to apply the first image to the base document layer such that the second ink does not wet out on areas printed with the first ink wherein the personalized image does not bond to the first image but does bond to the base document layer in areas of the no first image being present and wherein the printed areas of the first image are embedded within the personalized image and become overt and visible to a human being upon printing of the personalized image

16. The method of claim 15 wherein the base document layer comprises card stock for the identification document and the first image is pre-printed on the base document layer.

17. The method of claim 15 wherein the covert ink comprises a UV ink.

18. The method of claim 15 wherein the covert ink is pre-printed on the identification document before personal information is captured.

19. The method of claim 15 wherein the personalized image is printed with an ink jet printer.

20. The method of claim 15 wherein the first ink comprises a UV ink, a solvent based ink, or a water based ink.

* * * * *